US009892671B2

(12) United States Patent
Xiong et al.

(10) Patent No.: US 9,892,671 B2
(45) Date of Patent: Feb. 13, 2018

(54) METHOD AND DEVICE FOR PERFORMING GAMMA CORRECTION FOR LCD PANELS

(71) Applicant: WUHAN CHINA STAR OPTOELECTRONICS TECHNOLOGY CO., LTD., Wuhan, Hubei (CN)

(72) Inventors: Bin Xiong, Hubei (CN); Yingchi Wang, Hubei (CN); Gonghua Zou, Hubei (CN)

(73) Assignee: WUHAN CHINA STAR OPTOELECTRONICS TECHNOLOGY CO., LTD., Wuhan, Hubei (CN)

( * ) Notice: Subject to any disclaimer, the term of this patent is extended or adjusted under 35 U.S.C. 154(b) by 148 days.

(21) Appl. No.: 14/783,728

(22) PCT Filed: Aug. 10, 2015

(86) PCT No.: PCT/CN2015/086462
§ 371 (c)(1),
(2) Date: Oct. 9, 2015

(87) PCT Pub. No.: WO2017/000358
PCT Pub. Date: Jan. 5, 2017

(65) Prior Publication Data

US 2017/0140692 A1 May 18, 2017

(30) Foreign Application Priority Data

Jul. 2, 2015 (CN) ..... 2015 1 0387860

(51) Int. Cl.
*G09G 3/20* (2006.01)
*G09G 3/36* (2006.01)

(52) U.S. Cl.
CPC ..... *G09G 3/2074* (2013.01); *G09G 3/3607* (2013.01); *G09G 2320/0276* (2013.01);
(Continued)

(58) Field of Classification Search
CPC ..... G09G 3/2074; G09G 3/3607; G09G 2320/0276; G09G 2320/0626;
(Continued)

(56) References Cited

U.S. PATENT DOCUMENTS 6,686,953 B1 2/2004 Holmes
2002/0047822 A1* 4/2002 Senda ..... G09G 3/32 345/90

(Continued)

FOREIGN PATENT DOCUMENTS

CN 101707050 A 5/2010
CN 102968943 A 3/2013

(Continued)

*Primary Examiner* — Sejoon Ahn
(74) *Attorney, Agent, or Firm* — Ladas & Parry LLP

(57) ABSTRACT

A method of performing gamma correction for LCD panels includes: dividing the display area of a LCD panel to form n sub-areas of the display area; dividing all grey-scale images into n sets to form n sets of grey-scale images; displaying a first chosen grey-scale image of each set of grey-scale images on the corresponding sub-area of n sub-areas concurrently; detecting the brightness of the first chosen grey-scale image with a photosensor installed on the sub-area; examining if there is grey-scale image pending for detection in the set of grey scale images; extracting a gamma curve of the LCD panel; and correcting the gamma curve of the LCD panel.

14 Claims, 3 Drawing Sheets

(52) U.S. Cl.
CPC ..... *G09G 2320/0626* (2013.01); *G09G 2320/0673* (2013.01); *G09G 2360/145* (2013.01); *G09G 2360/16* (2013.01)

(58) Field of Classification Search
CPC ..... G09G 2320/0673; G09G 2320/145; G09G 2360/16
See application file for complete search history.

(56) References Cited

U.S. PATENT DOCUMENTS

| | | | | |
|---|---|---|---|---|
| 2004/0008172 | A1* | 1/2004 | Nakamura | G06F 3/0412 345/89 |
| 2005/0218303 | A1* | 10/2005 | Poplin | G01J 1/42 250/214 AL |
| 2007/0018072 | A1* | 1/2007 | Koh | H04N 3/155 250/206 |
| 2008/0074361 | A1* | 3/2008 | Lee | G09G 3/32 345/77 |
| 2008/0252653 | A1* | 10/2008 | Alessi | G09G 3/3208 345/589 |
| 2014/0125674 | A1 | 5/2014 | Wu et al. | |

FOREIGN PATENT DOCUMENTS

| | | | |
|---|---|---|---|
| CN | 103985333 | A | 8/2014 |
| JP | 2000-197071 | A | 7/2000 |

* cited by examiner

METHOD AND DEVICE FOR PERFORMING GAMMA CORRECTION FOR LCD PANELS

BACKGROUND OF THE INVENTION

1. Field of the Invention

The present invention relates to liquid crystal display (LCD) technology, and more specifically, to a method and a device to perform gamma correction for LCD panels.

2. Description of the Prior Art

As the society develops, consumers have higher and higher demand on display quality of LCD panels, especially on the gamma curve that reflects the changes in grey scale and brightness of images.

Currently, LCD panel gamma correction is performed in the following procedure. First, display images at grey-scale level from zero to 255 on a LCD panel, then detect the display brightness of each grey-scale image, so to extract a gamma curve of the LCD panel displaying grey-scale images spanning from level zero to 255. The gamma curve extracted then is compared with a pre-defined gamma curve, and the brightness of each grey-scale image is adjusted according to the result of the comparison. This is how gamma curve is corrected.

But in actual practice, figure of brightness of grey-scale images must be extracted for 256 times while the LCD panel displaying 256 grey-scale images, so to acquire the corresponding gamma curve. The operation time is longer and at higher cost.

Therefore, it is necessary to provide a method and device to perform gamma correction for LCD panels so to solve problems with the existing technology.

SUMMARY OF THE INVENTION

One object of the present invention is to provide a method and device to perform gamma correction for LCD panels that requires shorter operation time and lower cost, so to solve the technical problems of current method and device to perform gamma correction, which requires longer operation time and higher cost.

According to the present invention, a method of performing gamma correction for LCD panels, comprises: Step A1: dividing the display area of a LCD panel to form n sub-areas of the display area, where n is a positive integer equivalent to or larger than 2; Step A2: dividing all grey-scale images into n sets to form n sets of grey-scale images, where each set of grey-scale images, comprising a plurality of grey-scale images, corresponds to one specific sub-area; Step A3: displaying a first chosen grey-scale image of each set of grey-scale images on the corresponding sub-area of n sub-areas concurrently, where the first chosen grey-scale image is any one of the grey-scale images in the set of grey-scale images; Step A4: detecting the brightness of the first chosen grey-scale image with a photosensor installed on the sub-area; Step A5: examining if there is grey-scale image pending for detection in the set of grey scale images, wherein the image pending for detection was not the first chosen grey-scale image; if there is grey-scale image pending for detection, then replace the first chosen grey-scale image with the grey-scale image pending for detection in the set of grey-scale images, and continue with step A3; if there is no grey-scale image pending for detection, then continue with step A6; Step A6: extracting a gamma curve of the LCD panel based on the grey scale and brightness of the first chosen grey-scale images; and Step A7: correcting the gamma curve of the LCD panel based on a pre-defined gamma curve. The step A3 comprises: displaying the first chosen grey-scale image of the set of grey-scale images from images at the highest grey scale level to the lowest grey scale level, or from images at the lowest grey scale level to the highest grey scale level on the corresponding sub-area. The step A4 comprises: Step A41: installing a photosensor in the middle of the sub-area and sticking the light-receiving surface of the photosensor on the sub-area; Step A42: detecting an analog signal of the brightness of the first chosen grey-scale image with the photosensor; and Step A43: converting the analog signal of the brightness of the first chosen grey-scale image into a digital signal of the brightness of the first chosen grey-scale image.

Furthermore, the step A7 comprises: Step A71: examining the difference in brightness of each grey-scale image between the gamma curve of the LCD panel and the pre-defined gamma curve; Step A72: performing brightness compensation based on a difference in brightness of each grey-scale image so to acquire a brightness compensation value, and Step A73: correcting the gamma curve of the LCD panel with the brightness compensation value.

Furthermore, step A72 comprises: performing brightness compensation with Fourier convert based on the difference in brightness of each grey-scale image to acquire the brightness compensation value.

Furthermore, the method further comprises: Step A8: storing the brightness compensation value of each grey-scale image and recording the brightness compensation value to a driver IC of the LCD panel.

Furthermore, the step A8 comprises: recording the brightness compensation value to the driver IC of the LCD panel through a mobile industry processor interface (MIPI).

Furthermore, each sub-area is of the same size.

Furthermore, each set of grey-scale images comprises the same number of grey-scale images.

According to the present invention, a method of performing gamma correction for LCD panels, comprises: Step A1: dividing the display area of a LCD panel to form n sub-areas of the display area, where n is a positive integer equivalent to or larger than 2; Step A2: dividing all grey-scale images into n sets to form n sets of grey-scale images, where each set of grey-scale images, comprising a plurality of grey-scale images, corresponds to one specific sub-area; Step A3: displaying a first chosen grey-scale image of each set of grey-scale images on the corresponding sub-area of n sub-areas concurrently, where the first chosen grey-scale image is any one of the grey-scale images in the set of grey-scale images; Step A4: detecting the brightness of the first chosen grey-scale image with a photosensor installed on the sub-area; Step A5: examining if there is grey-scale image pending for detection in the set of grey scale images, wherein the image pending for detection was not the first chosen grey-scale image; if there is grey-scale image pending for detection, then replace the first chosen grey-scale image with the grey-scale image pending for detection in the set of grey-scale images, and continue with step A3; if there is no grey-scale image pending for detection, then continue with step A6; Step A6: extracting a gamma curve of the LCD panel based on the grey scale and brightness of the first chosen grey-scale images; and Step A7: correcting the gamma curve of the LCD panel based on a pre-defined gamma curve.

Furthermore, the step A3 comprises: displaying the first chosen grey-scale image of the set of grey-scale images from images at the highest grey scale level to the lowest grey scale level, or from images at the lowest grey scale level to the highest grey scale level on the corresponding sub-area.

Furthermore, the step A4 comprises: Step A41: installing a photosensor in the middle of the sub-area and sticking the light-receiving surface of the photosensor on the sub-area; Step A42: detecting an analog signal of the brightness of the first chosen grey-scale image with the photosensor; and Step A43: converting the analog signal of the brightness of the first chosen grey-scale image into a digital signal of the brightness of the first chosen grey-scale image.

Furthermore, the step A7 comprises: Step A71: examining the difference in brightness of each grey-scale image between the gamma curve of the LCD panel and the pre-defined gamma curve; Step A72: performing brightness compensation based on a difference in brightness of each grey-scale image so to acquire a brightness compensation value, and Step A73: correcting the gamma curve of the LCD panel with the brightness compensation value.

Furthermore, the step A72 comprises: performing brightness compensation with Fourier convert based on the difference in brightness of each grey-scale image to acquire the brightness compensation value.

Furthermore, the method further comprises: Step A8: storing the brightness compensation value of each grey-scale image and recording the brightness compensation value to a driver IC of the LCD panel.

Furthermore, the step A8 comprises: recording the brightness compensation value to the driver IC of the LCD panel through a mobile industry processor interface (MIPI).

Furthermore, each sub-area is of the same size.

Furthermore, each set of grey-scale images comprises the same number of grey-scale images.

According to the present invention, a gamma correction device for LCD panels, comprises: a display area dividing module, to divide the display area of a LCD panel so to form n sub-areas, where n is a positive integer equivalent to or larger than 2; an grey-scale images dividing module, to divide all grey-scale images into n sets to form n sets of grey-scale images, wherein each set of grey-scale images, comprising a plurality of grey-scale images, corresponds to a specific sub-area; a display module, to display a first chosen grey-scale image of each set of grey-scale images on the corresponding sub-area concurrently, wherein the first chosen grey-scale image is any one of the grey-scale images in each set of grey-scale images; a brightness detecting module, to detect the brightness of the first chosen grey-scale image with the photosensor installed on the sub-area; an examining module, to examine if there is grey-scale image pending for detection in the set of grey-scale images, wherein the grey-scale image pending for detection is not the first chosen grey-scale image; a grey-scale image replacing module, to replace the first chosen grey-scale image with the grey-scale image pending for detection in the corresponding set of grey-scale images; a gamma curve extracting module, to extract a gamma curve of the LCD panel based on the grey scale and brightness of the first chosen grey-scale images, and a gamma curve adjusting module to adjust the gamma curve of the LCD panel based on a pre-defined gamma curve.

Furthermore, the display module, displays the first chosen grey-scale image of the set of grey-scale images from images at the highest grey scale level to the lowest grey scale level, or from images of the lowest grey scale level to the highest grey scale level on the corresponding sub-area.

Furthermore, each sub-area is of the same size.

Furthermore, each set of grey-scale images comprises the same number of grey-scale images.

Comparing with the existing technology, the method and device to perform gamma correction for LCD panels of the present invention makes use of a plurality of sub-areas of the display area (hereinafter refers to as sub-areas) to display a plurality of grey-scale images concurrently, greatly reducing the operation time and cost needed to perform gamma correction. It solves the technical problems of current method and device to perform gamma correction, which requires longer operation time and higher cost.

These and other features, aspects and advantages of the present disclosure will become understood with reference to the following description, appended claims and accompanying figures.

DETAILED DESCRIPTION OF THE PREFERRED EMBODIMENTS

Figure 1:
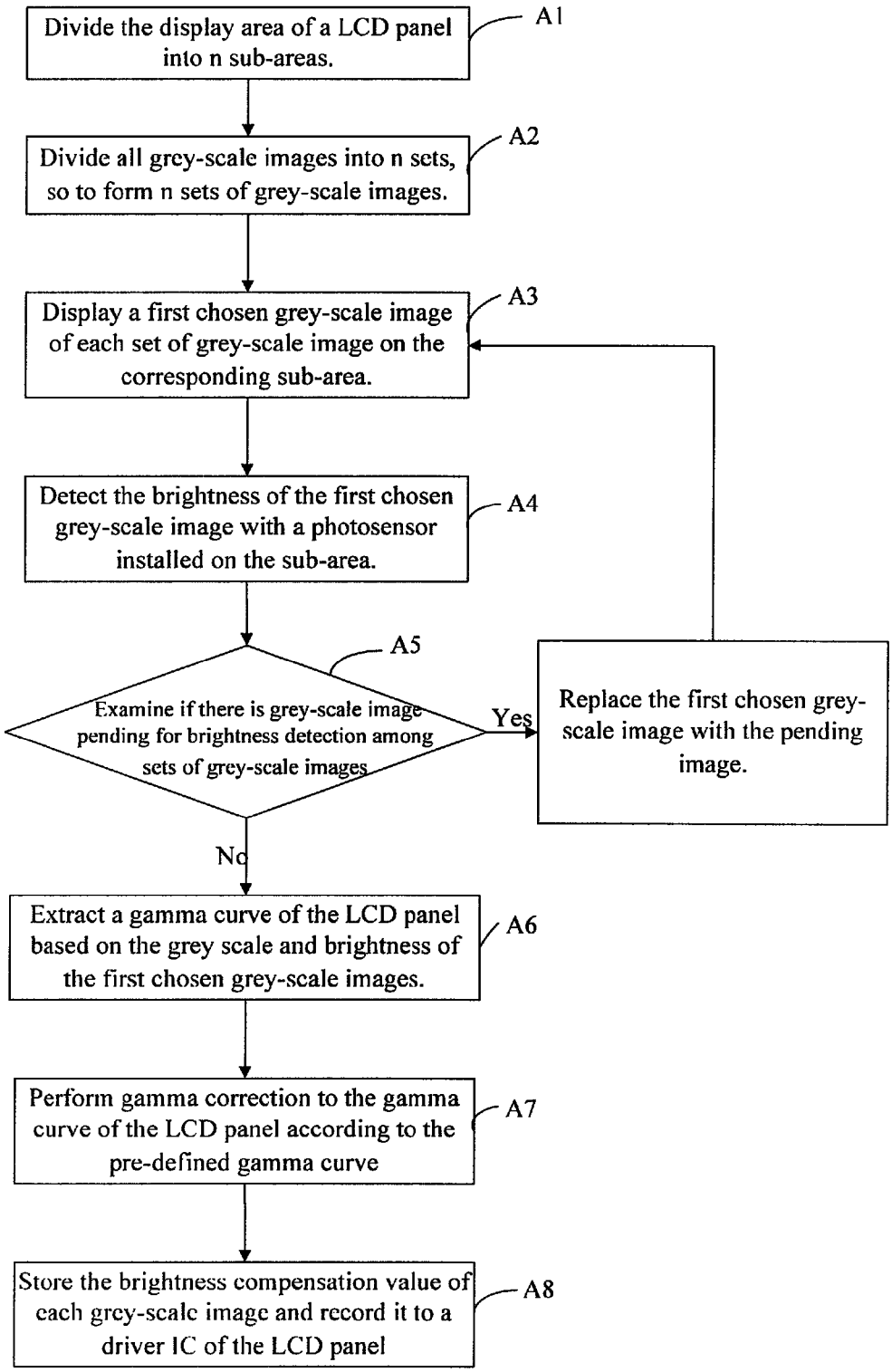
FIG. 1 shows a flowchart of a method for performing gamma correction for LCD panels according to a preferred embodiment of the present invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures.

The invention is described below in detail with reference to the accompanying drawings, wherein like reference numerals are used to identify like elements illustrated in one or more of the figures thereof, and in which exemplary embodiments of the invention are shown.

Please refer to FIG. 1, showing a flowchart of a method for performing gamma correction for LCD panels according to a preferred embodiment of the present invention. The method for performing gamma correction for LCD panels of the preferred embodiment comprises:

Step A1: divide the display area of a LCD panel into n sub-areas;

Step A2: divide all grey-scale images into n sets, so to form n sets of grey-scale images;

Step A3: display a first chosen grey-scale image of each set of grey-scale image on the corresponding sub-area;

Step A4: detect the brightness of the first chosen grey-scale image with a photosensor installed on the sub-area;

Step A5: examine if there is grey-scale image pending for brightness detection among sets of grey-scale images. If there is image pending for brightness detection among sets of grey-scale images, replace the first chosen grey-scale image with the pending image, then continue with step A3. If no image among sets of grey scale images is pending for brightness detection, continue step A6.

Step A6: extract a gamma curve of the LCD panel based on the grey scale and brightness of the first chosen grey-scale images.

Step A7: perform gamma correction to the gamma curve of the LCD panel according to the pre-defined gamma curve.

Step A8: store the brightness compensation value of each grey-scale image and record it to a driver integrated circuit (IC) of the LCD panel.

Steps of a substantive procedure of the method for performing gamma correction for LCD panels of the present embodiment are explained in detail in the following texts.

In step A1, a gamma correction device divides the display area of the LCD panel, so to form n sub-areas. The "n" is a positive integer equivalent to or larger than 2. For the convenience of the division, each sub-area is of the same size. If the display area is divided into two sub-areas, the two sub-areas can be arranged from top to bottom or left to right. If it is divided into three sub-areas, they can be arranged from top, middle to bottom or left, middle to right. If it is divided into four areas, they can be arranged as a four-square grid. Then continue with step A2.

In step A2, the gamma correction device divides all grey-scale images of the LCD panel into n sets to form n sets of grey-scale images. So each set of grey-scale images, comprising a plurality of grey-scale images at different grey scale level, corresponds to a specific sub-area. Then continue with step A3.

In step A3, the gamma correction device displays the first chosen grey-scale image of each set of grey scale images defined in step A2 on the corresponding sub-area among n sub-areas defined in step A1. The first chosen grey-scale image can be any one of the grey-scale images of the set of grey-scale images. It means that each sub-area can display all grey-scale images in the corresponding set of grey-scale images by defining a first chosen grey-scale image. For the convenience of sub-areas to display grey-scale images, each sub-area can display the first chosen grey-scale image in the corresponding set of grey-scale images from the one at the highest grey scale level to the one at the lowest grey scale level, or from the one at the lowest grey scale level to the one at the highest grey scale level. Then continue with step A4.

Figure 2:
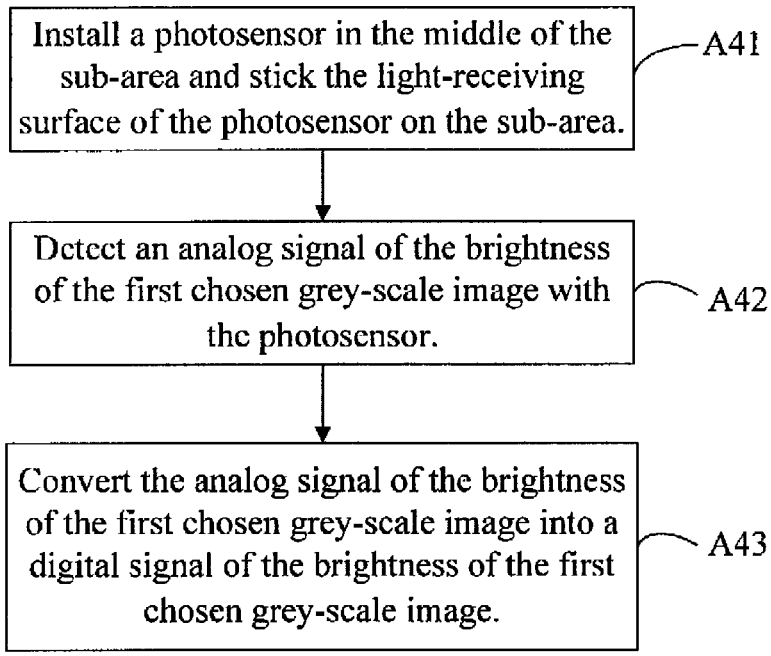
FIG. 2 shows a flowchart of the step A4 of the method for performing gamma correction for LCD panels according to a preferred embodiment of the present invention.

In step A4, the gamma correction device detects the brightness of the first chosen grey-scale images with the photosensor installed on the sub-areas. Please refer to FIG. 2, a flow chart of step A4 on a method for performing gamma correction for LCD panels of the preferred embodiment of the present invention, for specific details. Step A4 comprises:

Step A41: the gamma correction device installs the photosensor in the middle of the sub-areas, and sticks the light-receiving surface of the photosensor on the sub-areas so to better sensing the display brightness of the sub-areas. It also prevents the brightness of the grey-scale image of a neighboring sub-area from affecting the brightness detection of the present sub-area. Then continue with step A42.

Step A42: gamma correction device detects an analog signal of the brightness of the first chosen grey-scale image with the photosensor. Then continue with step A43.

Step A43: gamma correction device converts the analog signal of the brightness of the first chosen grey-scale image into a digital signal of the brightness of the first chosen grey-scale image, so to perform brightness compensation afterwards. Then continue with step A5.

In step A5, the gamma correction device examines if there is grey-scale image pending for brightness detection among sets of grey scale images. The grey-scale image pending for brightness detection was not chosen as the first chosen grey-scale images. If there is grey-scale image pending for brightness detection among sets of grey scale images, replace the first chosen grey-scale image with the pending image, and continue with step A3, so to extract the brightness of all grey-scale images of the set of grey scale images. If there is no grey-scale image pending for brightness detection among sets of grey scale images, it means that the brightness of all grey-scale images of sets of grey scale images is extracted. Then continue with step A6.

In step A6, the gamma correction device acquires a gamma curve of the LCD panel according to the grey scale of the first chosen grey-scale images and the brightness of the first chosen grey-scale images extracted in step A4. Then continue with step A7.

Figure 3:
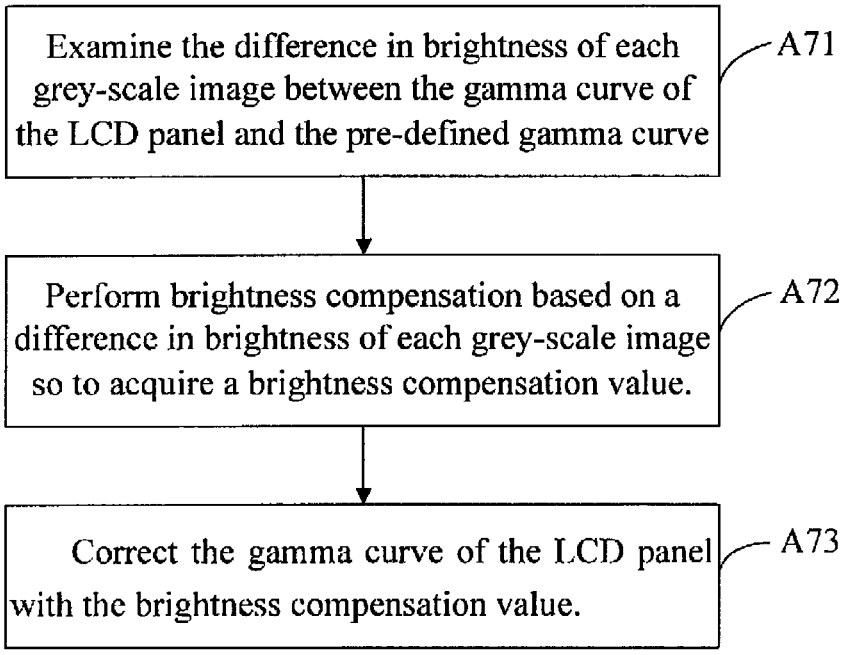
FIG. 3 shows a flowchart of the step A7 of the method for performing gamma correction for LCD panels according to a preferred embodiment of the present invention.

In step A7, the gamma correction device adjusts the gamma curve acquired in step A6 according to a pre-defined gamma curve. FIG. 3 is a flow chart of step A7 on a method for performing gamma correction for LCD panels of the present invention. Step A7 comprises:

Step A71: the gamma correction device examines the difference in brightness of each grey-scale image between the gamma curve of the LCD panel and the pre-defined gamma curve.

Step A72: the gamma correction device, based on the difference in brightness of each grey-scale image extracted in step A71, performs brightness compensation to each grey-scale image with Fourier convert so to acquire the brightness compensation value of each grey-scale image.

Step A73: the gamma correction device adjusts the gamma curve of the LCD panel with the brightness compensation value acquired in step A72, and examines whether the gamma curve of the LCD panel after adjustment is in line with the pre-defined gamma curve. Then continue with step A8.

In step A8, given that the gamma curve of the LCD panel has been confirmed as correctly adjusted in step A7, the gamma correction device stores the brightness compensation value of each grey-scale image and records the brightness compensation values to the driver IC of the LCD panel through mobile industry processor interface (MIPI), so to drive the display brightness of the LCD panel.

The gamma correction process for LCD panels of the present embodiment is completed here.

The method for performing gamma correction for LCD panels of the present invention displays a plurality of grey-scale images on a plurality of sub-areas concurrently. It greatly reduces the operation time and cost needed to perform gamma curve correction.

Figure 4:
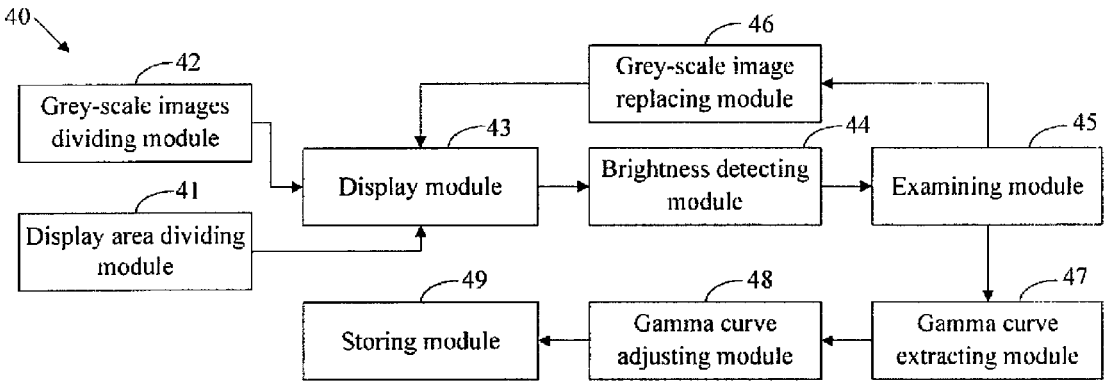
FIG. 4 shows a gamma correction device for LCD panels according to a preferred embodiment of the present invention.

The present invention further provides a gamma correction device for LCD panels. Please refer to FIG. 4, showing a structure diagram of the gamma correction device for LCD panels of a preferred embodiment of the present invention. The gamma correction device 40 of the present embodiment comprises a display area dividing module 41, a grey-scale images dividing module 42, a display module 43, a brightness detecting module 44, an examining module 45, a grey-scale image replacing module 46, a gamma curve extracting module 47, a gamma curve adjusting module 48 and a storing module 49.

The display area dividing module 41 divides the display area of the LCD panel so to form n sub-areas, with n being a positive integer equivalent to or larger than 2. The grey-scale images dividing module 42 divides all grey-scale images into n sets, to form n sets of grey-scale images. Each set of grey-scale images, comprising a plurality of grey-scale images at different grey scale level, corresponds to one specific sub-area. The display module 43 displays a first chosen grey-scale images of each set of grey-scale images on the corresponding sub-area among n sub-areas. The first chosen grey-scale image can be any one of the grey-scale images in the set of grey-scale images. The brightness detecting module 44 detects the brightness of the first chosen grey-scale image with a photosensor installed on the sub-area. The examining module 45 examines if there is grey-scale image pending for detection in the set of grey scale images. The grey-scale image pending for detection was not the first chosen grey-scale image. The grey-scale image replacing module 46 replaces the first chosen grey-scale image with the image pending for detection in the corresponding set of grey-scale images. The gamma curve extracting module 47 extracts the gamma curve of the LCD panel based on the grey scale and brightness of the first chosen grey-scale images. The gamma curve adjusting module 48 adjusts the gamma curve of the LCD panel based on a pre-defined gamma curve. The storing module 49 stores the brightness compensation value of each grey-scale image and records the brightness compensation value to the driver IC of the LCD panel.

The gamma correction device 40 for LCD panels of the present embodiment operates in the following steps. First, display area dividing module 41 divides the display area of the LCD panel so to form n sub-areas, with n being an integer equivalent to or larger than 2. For the convenience of division, each sub-area is of the same size. If the panel is divided into two sub-areas, they can be arranged from top to bottom or left to right. If it is divided into three sub-areas, they can be arranged from top, middle to bottom or left, middle to right. If it is divided into four sub-areas, they can be arranged as a four-square grid.

Then, the grey-scale images dividing module 42 divides all grey-scale images of the LCD panel into n sets to form n sets of grey-scale images. Each set of grey-scale images, comprising a plurality of grey-scale images at different grey scale level, corresponds to one specific sub-area.

Then, the display module 43 displays a first chosen grey-scale image of each set of grey-scale images defined by the grey-scale images dividing module 42 on the n sub-areas defined by the display area dividing module 41 concurrently. The first chosen grey-scale image can be any one of the grey-scale images in the set of grey-scale images. It means that each sub-area can display all grey-scale images in the corresponding set of grey-scale images by defining a first chosen grey-scale image. For the convenience of sub-areas to display grey-scale images, each sub-area can display the first chosen grey-scale image in the corresponding set of grey-scale images from the one at the highest grey scale level to the one at the lowest grey scale level, or from the one at the lowest grey scale level to the one at the highest grey scale level.

Then, the brightness detecting module 44 detects the brightness of the first chosen grey-scale image with the photosensor installed on the sub-areas.

And then, the examining module 45 examines if there is grey-scale image pending for brightness detection among sets of grey scale images, wherein the grey-scale image pending for brightness detection is not the first chosen grey-scale image. If there is image pending for brightness detection, replace the first chosen grey-scale image with the pending image. Then, the display module 43 again displays the first chosen grey-scale image of each set of grey-scale images on the corresponding sub-area, so to acquire the brightness of all the grey-scale images of each set of grey-scale images. If no image among sets of grey scale images is pending for brightness detection, it means that the brightness of all grey-scale images has been acquired.

Then, the gamma curve extracting module 47 extracts the gamma curve of the LCD panel based on the grey scale of the first chosen grey-scale images and the brightness of the first chosen grey-scale images acquired by the brightness detecting module 44.

And then, the gamma curve adjusting module 48, based on the pre-defined gamma curve, adjusts the gamma curve of the LCD panel extracted by the gamma curve extracting module 47.

Finally, after the correction of the gamma curve of the LCD panel has been confirmed, the storing module 49 stores the brightness compensation value of each grey-scale image and records the brightness compensation value to a driver IC of the LCD panel through MIPI, so to drive the display brightness of the LCD panel.

This concludes the gamma correction process for LCD panels of the present embodiment.

Specific operating principles of the gamma correction device for LCD panels of the present embodiment is identical or similar to that described in the method for performing gamma correction for LCD panels of the preferred embodiment. Please refer to related description in the method for performing gamma correction for LCD panels of the preferred embodiment for specifics.

The method and device to perform gamma correction for LCD panels of the present invention display a plurality of grey-scale images on a plurality of sub-areas concurrently. It greatly reduces the operation time and cost needed to perform gamma curve correction, and solves the technical problems of longer operation time and higher operation cost resulted from the existing method and device to perform gamma correction for LCD panels.

The present disclosure is described in detail in accordance with the above contents with the specific preferred examples. However, this present disclosure is not limited to the specific examples. For the ordinary technical personnel of the technical field of the present disclosure, on the premise of keeping the conception of the present disclosure, the technical personnel can also make simple deductions or replacements, and all of which should be considered to belong to the protection scope of the present disclosure.

What is claimed is:

1. A method of performing gamma correction for liquid crystal display (LCD) panel, comprising:

Step A1: dividing a display area of a LCD panel to form n sub-areas of the display area, where n is a positive integer equivalent to or larger than 2;

Step A2: dividing all grey-scale images into n sets to form n sets of grey-scale images, where each set of grey-scale images, comprising a plurality of grey-scale images, corresponds to one specific sub-area;

Step A3: displaying a first chosen grey-scale image of each set of grey-scale images on the corresponding sub-area of n sub-areas concurrently, where the first chosen grey-scale image is any one of the grey-scale images in the set of grey-scale images;

Step A4: detecting a brightness of the first chosen grey-scale image with photosensors installed on the sub-areas;

Step A5: examining if there is grey-scale image pending for detection in the set of grey-scale images, wherein the grey-scale image pending for detection was not the first chosen grey-scale image; if there is grey-scale image pending for detection, then replace the first chosen grey-scale image with the grey-scale image pending for detection in the set of grey-scale images, and continue with step A3; if there is no greyscale image pending for detection, then continue with step A6;

Step A6: extracting a gamma curve of the LCD panel based on the grey-scale and brightness of the first chosen grey-scale images; and Step A7: correcting the gamma curve of the LCD panel based on a pre-defined gamma curve;

wherein the step A3 comprises:

displaying the first chosen grey-scale image of the set of grey-scale images from images at the highest grey-scale level to the lowest grey-scale level, or from images at the lowest grey-scale level to the highest grey-scale level on the corresponding sub-area; and the step A4 comprises:

Step A41: installing a photosensor in the middle of the sub-area and sticking the light-receiving surface of the photosensor on the sub-area;

Step A42: detecting an analog signal of the brightness of the first chosen greyscale image with the photosensor; and Step A43: converting the analog signal of the brightness of the first chosen greyscale image into a digital signal of the brightness of the first chosen grey-scale image, wherein the step A7 comprises:

Step A71: examining difference in brightness of each grey-scale image between the gamma curve of the LCD panel and the pre-defined gamma curve;

Step A72: performing brightness compensation based on the difference in brightness of each grey-scale image so to acquire a brightness compensation value; and Step A73: correcting the gamma curve of the LCD panel with the brightness compensation value.

2. The method of claim 1, wherein step A72 comprises:

performing brightness compensation with Fourier convert based on the difference in brightness of each grey-scale image to acquire the brightness compensation value.

3. The method of claim 1 further comprising:

Step A8: storing the brightness compensation value of each grey-scale image and recording the brightness compensation value to a driver IC of the LCD panel.

4. The method of claim 3, wherein the step A8 comprises:

recording the brightness compensation value to the driver IC of the LCD panel through a mobile industry processor interface (MIPI).

5. The method of claim 1, wherein each sub-area is of the same size.

6. The method of claim 1, wherein each set of grey-scale images comprises the same number of grey-scale images.

7. A method of performing gamma correction for LCD liquid crystal display (LCD) panel, comprising:

Step A1: dividing a display area of a LCD panel to form n sub-areas of the display area, where n is a positive integer equivalent to or larger than 2;

Step A2: dividing all grey-scale images into n sets to form n sets of grey-scale images, where each set of grey-scale images, comprising a plurality of grey-scale images, corresponds to one specific sub-area;

Step A3: displaying a first chosen grey-scale image of each set of grey-scale images on the corresponding sub-area of n sub-areas concurrently, where the first chosen grey-scale image is any one of the grey-scale images in the set of grey-scale images;

Step A4: detecting a brightness of the first chosen grey-scale image with photosensors installed on the subareas;

Step A5; examining if there is grey-scale image pending for detection in the set of grey-scale images, wherein the grey-scale image pending for detection was not the first chosen grey-scale image; if there is grey-scale image pending for detection, then replace the first chosen grey-scale image with the grey-scale image pending for detection in the set of grey-scale images, and continue with step A3; if there is no greyscale image pending for detection, then continue with step A6;

Step A6: extracting a gamma curve of the LCD panel based on the grey-scale and brightness of the first chosen grey-scale images; and Step A7; correcting the gamma curve of the LCD panel based on a predefined gamma curve, wherein the step A7 comprises;

Step A71: examining difference in brightness of each grey-scale image between the gamma curve of the LCD panel and the pre-defined gamma curve;

Step A72: performing brightness compensation based on the difference in brightness of each grey-scale image so as to acquire a brightness compensation value; and Step A73: correcting the gamma curve of the LCD panel with the brightness compensation value.

8. The method of claim 7, wherein the step A3 comprises:

displaying the first chosen grey-scale image of the set of grey-scale images from images at the highest grey-scale level to the lowest grey-scale level, or from images at the lowest grey-scale level to the highest grey-scale level on the corresponding sub-area.

9. The method of claim 7, wherein the step A4 comprises:

Step A41: installing a photosensor in the middle of the sub-area and sticking the light-receiving surface of the photosensor on the sub-area;

Step A42: detecting an analog signal of the brightness of the first chosen grey-scale image with the photosensor; and Step A43: converting the analog signal of the brightness of the first chosen grey-scale image into a digital signal of the brightness of the first chosen grey-scale image.

10. The method of claim 7, wherein step A72 comprises:

performing brightness compensation with Fourier convert based on the difference in brightness of each grey-scale image to acquire the brightness compensation value.

11. The method of claim 7 further comprising:

Step A8: storing the brightness compensation value of each grey-scale image and recording the brightness compensation value to a driver IC of the LCD panel.

12. The method of claim 11, wherein the step A8 comprises:

recording the brightness compensation value to the driver IC of the LCD panel through a mobile industry processor interface (MIPI).

13. The method of claim 7, wherein each sub-area is of the same size.

14. The method of claim 7, wherein each set of grey-scale images comprises the same number of grey-scale images.

* * * * *